US006147603A

United States Patent [19]

Rand

[11] Patent Number: 6,147,603

[45] Date of Patent: Nov. 14, 2000

[54] ANTI-THEFT COMPUTER SECURITY SYSTEM

[75] Inventor: Richard Rand, East Northport, N.Y.

[73] Assignee: Protex International Corp., Bohemia, N.Y.

[21] Appl. No.: 09/438,648

[22] Filed: Nov. 12, 1999

[51] Int. Cl.[7] ..... G08B 13/12

[52] U.S. Cl. ..... 340/568.2; 340/571; 340/568.4

[58] Field of Search ..... 340/568.1, 568.2, 340/568.3, 568.4, 571; 439/344, 917; 379/44

[56] References Cited

U.S. PATENT DOCUMENTS

| | | | |
|---|---|---|---|
| 5,034,723 | 7/1991 | Maman | 340/568.2 |
| 5,142,269 | 8/1992 | Mueller | 340/568.2 |
| 5,725,386 | 3/1998 | Davis et al. | 439/79 |
| 5,725,395 | 3/1998 | Lee | 439/610 |
| 5,767,771 | 6/1998 | Lamont | 340/571 |
| 5,821,857 | 10/1998 | Rand | 340/568.8 |
| 5,821,868 | 10/1998 | Kuhling | 340/649 |
| 6,067,014 | 5/2000 | Wilson | 340/540 |

OTHER PUBLICATIONS

Universal Serial Bus Specification Revision 1.1 Chapter 6, pp. 73–105, Sep. 1998.

*Primary Examiner*—Benjamin C. Lee
*Attorney, Agent, or Firm*—Collard & Roe, P.C.

[57] ABSTRACT

A computer anti-theft security system comprising a USB connector having a housing section and a contact connectd to the housing section is disclosed. A cable is connected to the contact and extends through the housing section. The contact inserts into a USB port of a computer or peripheral and the cable is then connected to a central alarm monitoring unit. A sensor is disposed within the housing and connected to the cable as well. If the USB connector is disconnected from the computer or peripheral, or if the cable is cut, an alarm sounds from the central alarm monitoring unit.

6 Claims, 2 Drawing Sheets

ANTI-THEFT COMPUTER SECURITY SYSTEM

BACKGROUND OF THE INVENTION

1. Field of the Invention

This invention relates to an anti-theft security system for computers using a universal serial bus port. In particular, the invention relates to a sensor integrated with a universal serial bus connector that connects the computer or peripheral with a central alarm system, so that if the connecting cable is cut or damaged, or the connector is disconnected, an alarm is triggered at the central alarm system.

2. The Prior Art

Computers in large business establishments, and especially those on display in electronics stores, are highly prone to theft. Therefore, many computers are manually locked to the workstations or display shelves with a bicycle-type lock to prevent theft. These locks, however strong, can often be broken and the computer then stolen, with no detection. Large work spaces or retail computer stores can have large numbers of computers in one small area, and would thus be at a great loss if the computers were stolen.

SUMMARY OF THE INVENTION

It is therefore an object of the invention to provide an anti-theft security system for computers that immediately alerts the owner if theft or tampering occurs.

It is another object of the invention to provide an anti-theft security system for computers that also prevents theft of peripherals such as scanners, printers and other machines.

It is yet another object of the invention to provide an anti-theft security system that can protect large numbers of computers and peripherals with a single central alarm unit.

It is a further object of the invention to provide an anti-theft security system that can be used on any brand of computer or peripheral having a universal serial bus port.

These and other objects of the invention are accomplished by a computer anti-theft security system comprising a USB connector having a housing section and a contact connected to the housing section. A cable is connected to the contact and extends through the housing section. The contact inserts into a USB port of a computer or peripheral and the cable is then connected to a central alarm monitoring unit. A sensor is disposed within the housing and connected to the cable as well. If the USB connector is disconnected from the computer or peripheral, or if the cable is cut, an alarm sounds from the central alarm monitoring unit. The USB connector is built like a standard USB connector, such as disclosed in U.S. Pat. No. 5,725,395 to Lee or U.S. Pat. No. 5,725,386 to Davis et al, both of which are herein incorporated by reference.

The central alarm monitoring unit is preferably that disclosed in U.S. Pat. No. 5,821,857 to Rand, the disclosure of which is herein incorporated by reference. Many USB connectors with sensors can be connected to a single central alarm monitoring unit, so that an entire store or office full of computers and peripherals can be protected with a single alarm unit.

USB connectors are divided into two types: Type "A" and type "B". Type A connectors are oriented upstream toward the host system, i.e., connected to the computer. Type "B" connectors are oriented downstream of the host system, i.e., connected to the peripheral. The system according to the invention can use either type A or type B connectors, or both.

The USB connector according to the invention is dimensioned and configured to fit commercially available computers and peripherals. The contact portion has a data+ and a data− terminal, which are connected to ground through a 15 kΩ resistor within the computer or peripheral. The general specifications for the contact portion and the dimensions of the USB connector according to the invention are well known in the art and are also disclosed in *Universal Serial Bus Specification Revision* 1.1, Chapter 6, pages 73–105, Sep. 23, 1998, available at www.usb.org/developers/data, the disclosure of which is herein incorporated by reference.

The cable is preferably a four conductor cable. The sensor within the USB connector according to the invention includes a light emitting diode (LED) connected to two wires in the cable. The LED is preferably bicolor and glows one color, i.e., green, when the connector is connected to a computer or peripheral and to the central alarm unit. The LED glows red when the connector is disconnected in any way, indicating an alarm status.

The sensor also includes a diode connected to the other two wires within the cable and to the computer or peripheral through the contact in the connector. The diode serves to indicate the presence of the sensor to the central alarm monitoring unit. The sensor works as follows: When the USB sensor is initally connected to the central alarm monitoring unit, the LED glows red, since the central alarm monitoring unit detects the presence of the sensor. Upon plugging the connector into the computer or peripheral, the DATA+ and DATA − lines are each connected to circuit ground via a 15 kΩ resistor within the computer. This resistor is a required element of all USB connections. The sensor delivers a small current into the Data (−) line and detects the current at the circuit ground connection of the USB connector, causing the LED to glow green. If the central alarm monitoring unit does not detect the return signal, either the connector is dislodged or the cable is broken. In either case, the central alarm monitoring unit will register an alarm and the LED on the sensor will switch from green to red.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
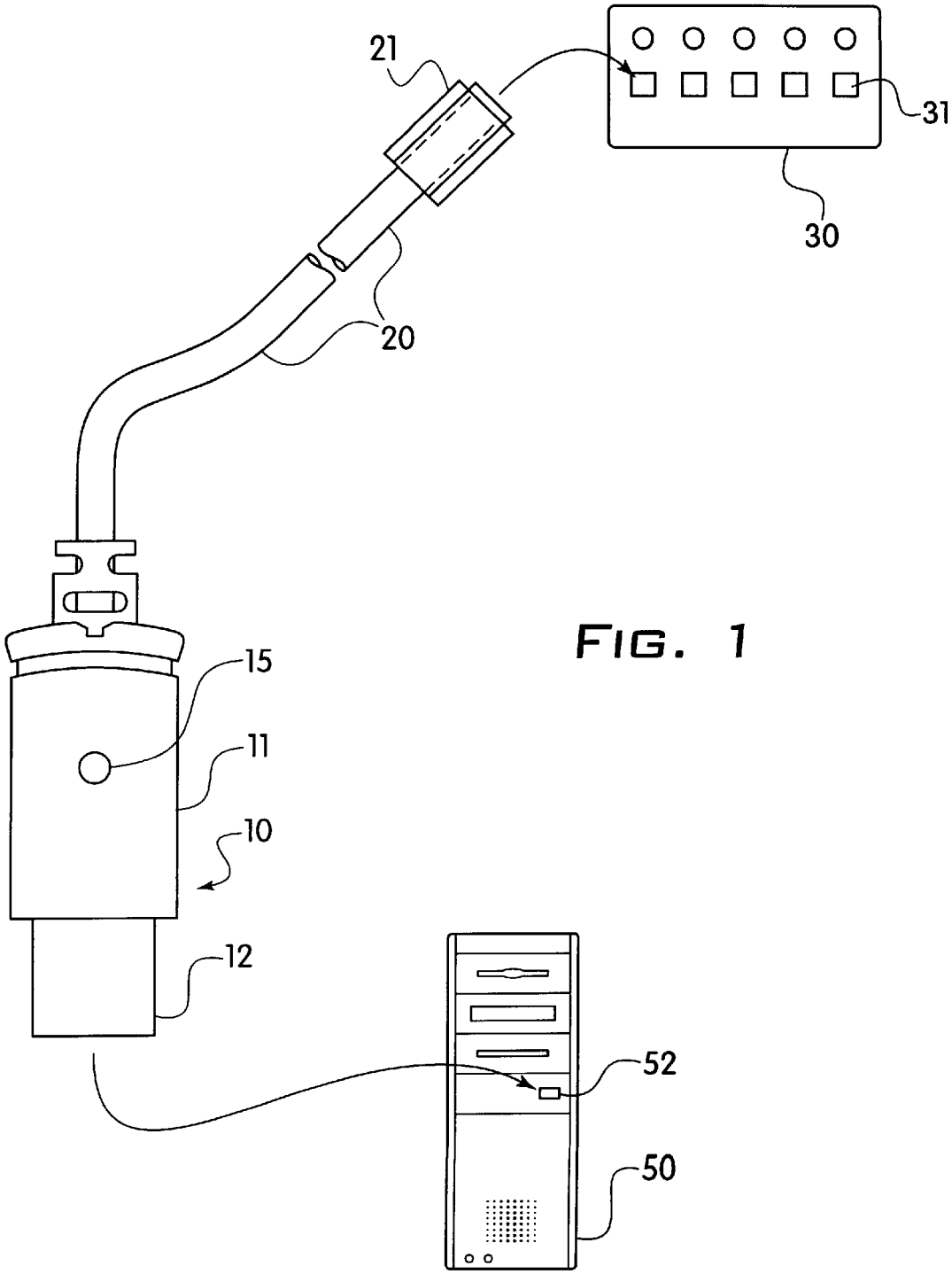
FIG. 1 shows an exploded schematic view of the system according to the invention.

Referring now in detail to the drawings, FIG. 1 shows an exploded view of the anti-theft computer security system according to the invention. The system comprises a USB connector 10 connected to a cable 20. Cable 20 is connected via connector 21 to a port 31 of central alarm monitoring unit 30. USB connector 10 plugs into a USB port of a computer 50 or a peripheral such as a printer or scanner (not shown).

Figure 2:
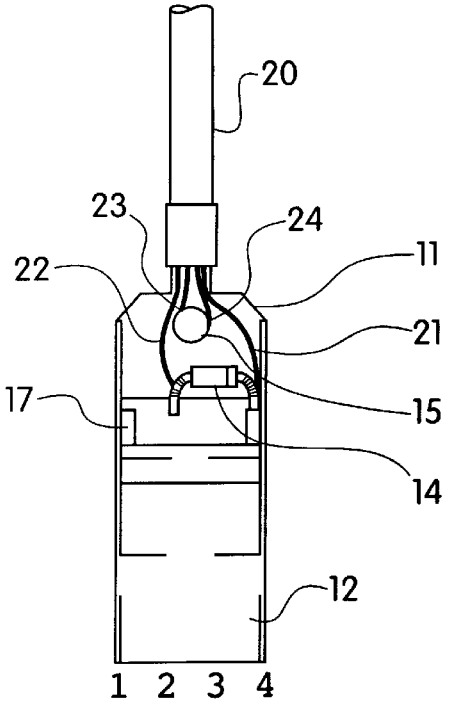
FIG. 2 shows a schematic internal view of the USB connector according to the invention.

As shown in FIG. 2, USB connector 10 is comprised of a housing 11, a contact 12 within the housing 11 and a sensor having an LED 15 that extends through housing 11. LED 15 is preferably a bi-color LED that glows green when USB connector 10 is connected to the central alarm monitoring unit 30 and to a computer 50 or other peripheral, and glows red when cable 20 is cut or USB connector 10 is disconnected from computer 50. USB connector 10 is configured as a standard USB connector that is adapted to fit USB ports on commercially available computers and peripherals. USB connector 10 could be either a type A connector, i.e., for a computer, or a type B connector, i.e., for a peripheral.

Figure 3:
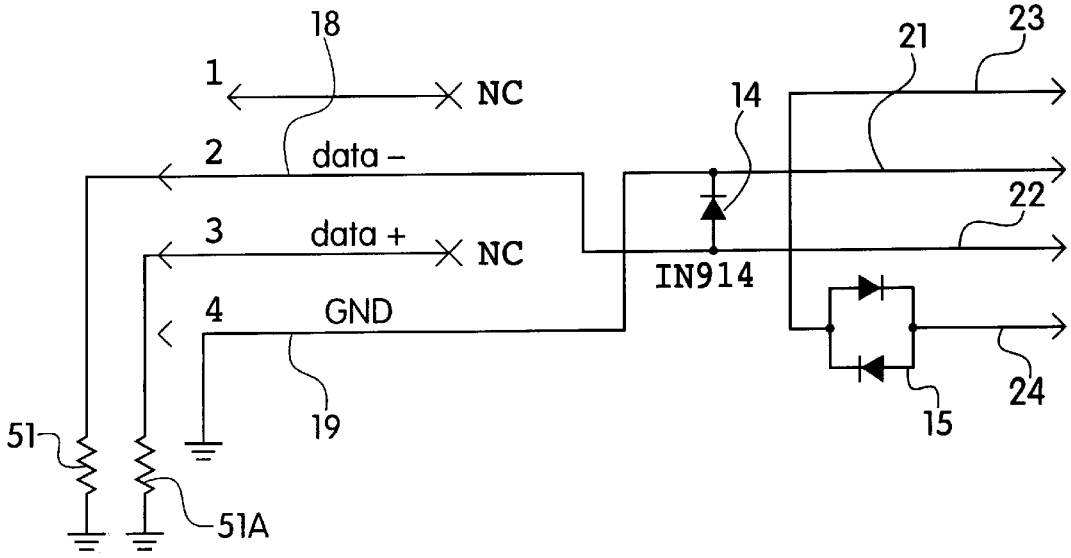
FIG. 3 shows an electronic diagram of the components of the USB connector according to the invention.

FIGS. 2 and 3 show the internal components of USB connector 10. Cable 20 is comprised of four wires, 21, 22, 23 and 24. Wires 23 and 24 are connected to LED 15 to illuminate LED 15. Wires 21 and 22 are connected to a diode 14, which is also connected to data− and ground terminals 18 and 19 of contact 12, through a jack 17. Terminals 18 and 19 connect to the computer 50 or peripheral through the computer's USB port 52.

In use, contact 12 of connector 10 is plugged into a USB port 52 of computer 50, and connector 21 of cable 20 is connected via port 31 to central alarm monitoring unit 30. At this point, a current is run through wires 21 and 22, in such polarity that it does not flow through diode 14, but instead flows into computer 50 through terminals 18 and 19, where it goes through 15 kΩ resistor 51 to ground. A return signal is detected by central alarm monitoring unit 30, indicating the presence of computer 50 to the system and LED 15 is illuminated green.

If cable 20 is cut, or if connector 10 is disconnected from computer 50, the central alarm monitoring unit 30 does not detect a return signal from the current through USB connector 10 and an alarm status is indicated.

Several computers and several USB connectors according to the invention can be connected to a single central alarm monitoring unit.

Accordingly, while only a single embodiment of the present invention has been shown and described, it is obvious that many changes and modifications may be made thereunto without departing from the spirit and scope of the invention.

What is claimed is:

1. An anti-theft computer security system, comprising:

a USB connector comprising:

(a) a housing;

(b) a contact extending from the housing and having data+ and data− terminals for connecting to a USB port on an electronic device;

(c) a sensor disposed within the housing;

a cable comprising a plurality of wires connected to the sensor and contact at one end and having a free end; and a central alarm monitoring unit connected to the free end of the cable, wherein said central alarm monitoring unit detects the presence of the sensor and sends an alarm signal when the connector is disconnected from the electronic device or the cable is cut.

2. The system according to claim 1, wherein the sensor comprises a diode connected to two wires in the cable and to the ground and data− terminals of the contact such that a circuit is completed when the connector is connected to an electronic device through a USB port, and wherein the circuit is broken when the connector is disconnected or the wire is cut.

3. The system according to claim 2, wherein the cable has four wires and wherein sensor further comprises a bi-color LED connected to the two wires not connected to the diode, said LED glowing one color when the connector is connected to an electronic device and to the central alarm monitoring unit, and glowing another color when the connector is disconnected from the electronic device.

4. A USB connector for connecting to an electronic device and to a central monitoring unit having an alarm, comprising:

a housing;

a contact extending from the housing for connecting to a USB port on an electronic device, said contact having ground and data− terminals;

a sensor disposed within the housing and connected to the contact; and a cable comprising a plurality of wires connected to the sensor and contact at one end and having a free end;

wherein the sensor activates the alarm when the cable is cut or the contact is disconnected from the electronic device.

5. The USB connector according to claim 4, wherein the sensor comprises a diode connected to two wires in the cable and to the ground and data− terminals of the contact such that a circuit is completed when the connector is connected to a USB port on an electronic device, and wherein the circuit is broken when the connector is disconnected or the wire is cut.

6. The USB connector according to claim 5, wherein the cable has four wires and wherein sensor further comprises a bi-color LED connected to the two wires not connected to the diode, said LED glowing one color when the connector is connected to an electronic device and to a central alarm monitoring unit, and glowing another color when the connector is disconnected from the electronic device.

* * * * *